US007455082B2

(12) United States Patent
Monzel

(10) Patent No.: US 7,455,082 B2
(45) Date of Patent: Nov. 25, 2008

(54) KEG FILLING PLANT FOR FILLING KEGS WITH A LIQUID BEVERAGE MATERIAL, SUCH AS BEER, WINE, SOFT DRINKS, OR JUICE, AND A METHOD OF OPERATING SAME, AND A HANDLING AND TREATMENT STATION FOR KEGS

(75) Inventor: Alois Monzel, Mörstadt (DE)

(73) Assignee: KHS Maschinen -Und Anlagenbau AG, Dortmund (DE)

( * ) Notice: Subject to any disclaimer, the term of this patent is extended or adjusted under 35 U.S.C. 154(b) by 215 days.

(21) Appl. No.: 11/428,764

(22) Filed: Jul. 5, 2006

(65) Prior Publication Data

US 2007/0169834 A1 Jul. 26, 2007

(30) Foreign Application Priority Data

Jul. 6, 2005 (DE) ..... 10 2005 031 573

(51) Int. Cl.
*B65B 3/04* (2006.01)

(52) U.S. Cl. ..... 141/18; 141/2; 141/172; 141/189; 141/89; 141/350; 141/113; 251/149.1

(58) Field of Classification Search ..... 141/18, 141/1, 113, 129, 165, 168, 170, 171, 172, 141/176, 250, 267, 268, 269, 270, 271, 279, 141/281, 283, 284, 248, 85–92, 348–350, 141/2; 251/149.1
See application file for complete search history.

(56) References Cited

U.S. PATENT DOCUMENTS 2,609,984 A * 9/1952 Barnes ..... 141/63
2,648,476 A * 8/1953 Kennedy, Jr. ..... 141/1
2,778,391 A * 1/1957 Muller ..... 141/349
2,794,451 A * 6/1957 Schmidt ..... 141/1
3,038,507 A * 6/1962 Smith ..... 141/117
3,221,374 A * 12/1965 Fornes ..... 19/159 R (Continued)

FOREIGN PATENT DOCUMENTS

BE 902 644 A2 9/1985

(Continued)

*Primary Examiner*—Ninh H. Nguyen
*Assistant Examiner*—Jason K Niesz
(74) *Attorney, Agent, or Firm*—Nils H. Ljungman & Associates

(57) ABSTRACT

Keg filling plant for filling kegs with a liquid beverage material, such as beer, wine, soft drinks, or juice, and a method of operating same, and a handling and treatment station for kegs. The abstract of the disclosure is submitted herewith as required by 37 C.F.R. §1.72(*b* ). As stated in 37 C.F.R. §1.72(*b* ): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 10 Drawing Sheets

U.S. PATENT DOCUMENTS 3,277,929 A * 10/1966 Cook ..... 141/92
3,374,985 A * 3/1968 Gessic ..... 251/252
3,442,303 A * 5/1969 Kellems ..... 141/18
3,563,287 A * 2/1971 Ruddick ..... 141/59
3,753,445 A * 8/1973 Johnston ..... 137/322
3,773,163 A * 11/1973 Ruddick ..... 198/358
3,831,645 A * 8/1974 Golding et al. ..... 141/92
3,866,626 A * 2/1975 Johnston ..... 137/322
3,880,182 A * 4/1975 Johnston ..... 137/212
3,880,206 A * 4/1975 Johnston ..... 141/5
3,913,608 A * 10/1975 Johnston ..... 137/322
4,028,791 A * 6/1977 Hodgetts ..... 29/426.3
4,102,450 A * 7/1978 Chapman et al. ..... 198/774.2
4,142,658 A * 3/1979 Golding ..... 222/400.7
4,150,771 A * 4/1979 Golding ..... 222/400.7
4,304,272 A * 12/1981 Golding ..... 141/92
4,319,612 A * 3/1982 Golding ..... 141/1
4,337,802 A * 7/1982 Kennedy et al. ..... 141/1
4,351,456 A * 9/1982 Nezworski ..... 222/400.7
4,406,313 A * 9/1983 Bennett et al. ..... 141/1
4,427,455 A * 1/1984 Schepper ..... 134/22.18
4,457,324 A * 7/1984 Schepper ..... 134/102.1
4,501,623 A * 2/1985 Till et al. ..... 134/22.18
4,685,598 A * 8/1987 Nezworski ..... 222/400.7
4,715,414 A * 12/1987 Harrison et al. ..... 141/302
4,809,342 A * 2/1989 Kappner ..... 382/142
5,000,661 A * 3/1991 Bloch et al. ..... 141/1
5,176,298 A * 1/1993 Mogler et al. ..... 222/400.7
5,285,825 A * 2/1994 Townsley ..... 141/9
5,552,114 A * 9/1996 Till ..... 422/26
5,585,917 A * 12/1996 Woite et al. ..... 356/237.1
5,634,501 A * 6/1997 Walshe ..... 141/92
5,649,575 A * 7/1997 Till ..... 141/90
5,662,226 A * 9/1997 Till ..... 209/2
5,876,511 A * 3/1999 Till ..... 134/22.1
6,494,238 B2 * 12/2002 Sindermann ..... 141/6
7,278,452 B2 * 10/2007 Taguchi et al. ..... 141/113
7,287,562 B2 * 10/2007 Tanikawa et al. ..... 141/367
2003/0006393 A1 * 1/2003 Hullegien et al. ..... 251/144
2004/0020947 A1 * 2/2004 Delbarre ..... 222/400.7
2006/0081660 A1 * 4/2006 Harvey et al. ..... 222/402.1
2006/0163292 A1 * 7/2006 Wauters et al. ..... 222/464.2

FOREIGN PATENT DOCUMENTS

DE 18 00 585 A1 7/1970
DE 30 14 746 A1 10/1981

* cited by examiner

KEG FILLING PLANT FOR FILLING KEGS WITH A LIQUID BEVERAGE MATERIAL, SUCH AS BEER, WINE, SOFT DRINKS, OR JUICE, AND A METHOD OF OPERATING SAME, AND A HANDLING AND TREATMENT STATION FOR KEGS

BACKGROUND

1. Technical Field

This application relates to a keg filling plant for filling kegs with a liquid beverage material, such as beer, wine, soft drinks, or juice. This application further relates to a handling and treatment station for the handling and treatment of kegs that are equipped with fittings, with an applicator element, a handling head, with a centering device and feed and discharge lines for handling and treatment media and/or the liquid being bottled and at least one actuator element for the valve element or elements of the fittings. A method of using a handling and treatment station for kegs is also described herein, as well as other advantageous developments and embodiments of both the station and the method of using the station.

2. Background Information

In situations where beverages or other liquid products must be handled and distributed in large quantities, e.g. in restaurants, it has been determined to be particularly advantageous to handle these products not in bottles or cans but in casks or drums. Therefore the use of kegs has numerous advantages. Kegs which may be used in conjunction with at least one possible embodiment disclosed herein are manufactured by SCHÄFER Container Systems, whose address is SCHÄFER WERKE GMBH, Postfach 1120, 57272 Neunkirchen, Federal Republic of Germany.

One major advantage of the use of kegs is that these barrel or drum-like containers, as the result of a particularly advantageous configuration of the connections for the liquid and compressed gas they contain are hermetically tight, and the contents and the interior of the container are therefore protected against contamination of all types, and primarily against contact with germs and other harmful microorganisms. The connections are combined into what are called fittings.

As a rule, kegs are handled, cleaned and refilled on an industrial scale in bottling plants, especially in the large plants of the bottled beverage industry. One example of a keg filling system is Innokeg Contikeg, manufactured by KHS Till GmbH, located at Kapellenstrasse 47-49, 65830 Kriftel, Federal Republic of Germany. An example of a control system for keg filling plants is the Innokeg InfoKeg Management System, also developed by KHS Till GmbH.

For this purpose, fully automated cleaning and bottling plants are used, in which the kegs are handled and treated on an individual machine with only one handling and treatment station, or on a large machine with a plurality of handling and treatment stations, e.g. 24-36.

The kegs are delivered empty to a delivery station of the plant and run through the cleaning and/or filling stations before they are removed at the other end of the plant, in clean and filled condition, and are then transported to the consumers.

In handling and treatment plants for kegs, it is conventional to move the kegs through the plant top-down, i.e. with the fitting facing downward, and in this orientation to also pressurize them with various handling media and/or with the liquid to be bottled and the compressed gas. The necessary connections between the interior of the kegs and the media and/or their delivery or discharge lines are thereby established by means of the keg fitting. The connection between the keg and the media line is established as follows: The keg 13 is delivered to a handling and treatment station by a suitable transport device. The step-by-step method is thereby used in practice.

During transport, the keg 13 is thereby oriented so that the fitting 14 is pointing downward. If the keg 13 is in an approximately perpendicular position and/or is oriented centrally over a handling position, the keg 13 is lowered from a raised transport position into a lower handling and treatment position, whereby it enters into a functional connection with a stationary centering device 15 and is thereby centered over and/or oriented in relation to a plunger 16. Simultaneously with the lowering into the handling position, an applicator element 17 is activated, whereupon the applicator element is pressed against the bottom of the keg to support the lowering and centering and then the application pressure necessary for the subsequent handling of the keg 13 is built up. After the keg 13 has been positioned and fixed in position, the kegs are handled and treated, whereby depending on the individual handling and treatment station, the process can be a cleaning or filling process.

For each of these handling and treatment processes, it is necessary to connect media lines with the keg or its interior, whereby the connections must be as tight and hygienic as possible, but must also be made rapidly and in a manner that protects the material. These requirements are met satisfactorily by the keg fittings that are widely used in practice.

To establish the connection of the media lines with the keg, on the handling and treatment station a handling head is provided which, in addition to the centering device 15 and the plunger 16, also has sealing elements and the delivery and/or discharge lines for the handling and treatment media, the liquid to be bottled or compressed gas to or from the handling head.

If the keg is then pressed in a sealed connection by means of the applicator element 17 against the seals that are located in the handling head, the plunger 16 is then moved by suitable actuator means from a first, low, non-engaged position into a second, higher, engaged position. During this movement, the plunger 16 opens the closures or valves that are provided on the keg fitting, and create a sealed connection with the corresponding contact surfaces, so that the handling and treatment media or the liquid being filled into the keg can be conducted into and out of the keg as desired. Once the handling or filling phase has been completed, the plunger moves into the non-engaged position, the closures of the keg fitting are closed by spring force and the content of the keg is packed hermetically tight.

In practice, partly for technical reasons and partly for reasons of intentional and desirable incompatibility, numerous keg fittings are in widespread use that differ from one another in their geometric such that each individual type of keg fitting requires, for the processing of the keg to which it is attached, at least its own plungers 16 and centering devices 15, as a result of which extensive conversion measures are necessary for each change in the type of keg or fitting being handled.

Attention must also be paid to the fact that in the beverage industry there are stringent requirements in terms of the cleanliness and safety of the cleaning and bottling process, as a result of which cleaning and/or disinfection measures may be necessary after the conversion measures that further increase the time required by and therefore also the costs entailed in such conversion measures.

These additional requirements have been found to be particularly disadvantageous in practice.

OBJECT

An object of at least one possible embodiment is to indicate a handling and treatment station for the handling of kegs that makes the conversion measures necessary for the handling and treatment of kegs with different fittings unnecessary. For this purpose, the application teaches a handling head which makes it possible to handle different fittings without the need for conversion measures.

SUMMARY

At least one possible embodiment is explained in greater detail below on the basis of one exemplary embodiment which is illustrated in the accompanying drawings.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

FIG. 1 is an overview drawing of a keg located in a handling and treatment station;

DESCRIPTION OF EMBODIMENT OR EMBODIMENTS

Developments, advantages and potential applications of at least one possible embodiment are explained in the following description of exemplary embodiments and of the accompanying drawings. All of the features described and/or graphically illustrated are the objects of the application, individually or in any possible combination, regardless of where they are placed in the claims or the references between claims. The text of the claims is simultaneously integrated by reference into the description.

Figure 1A:
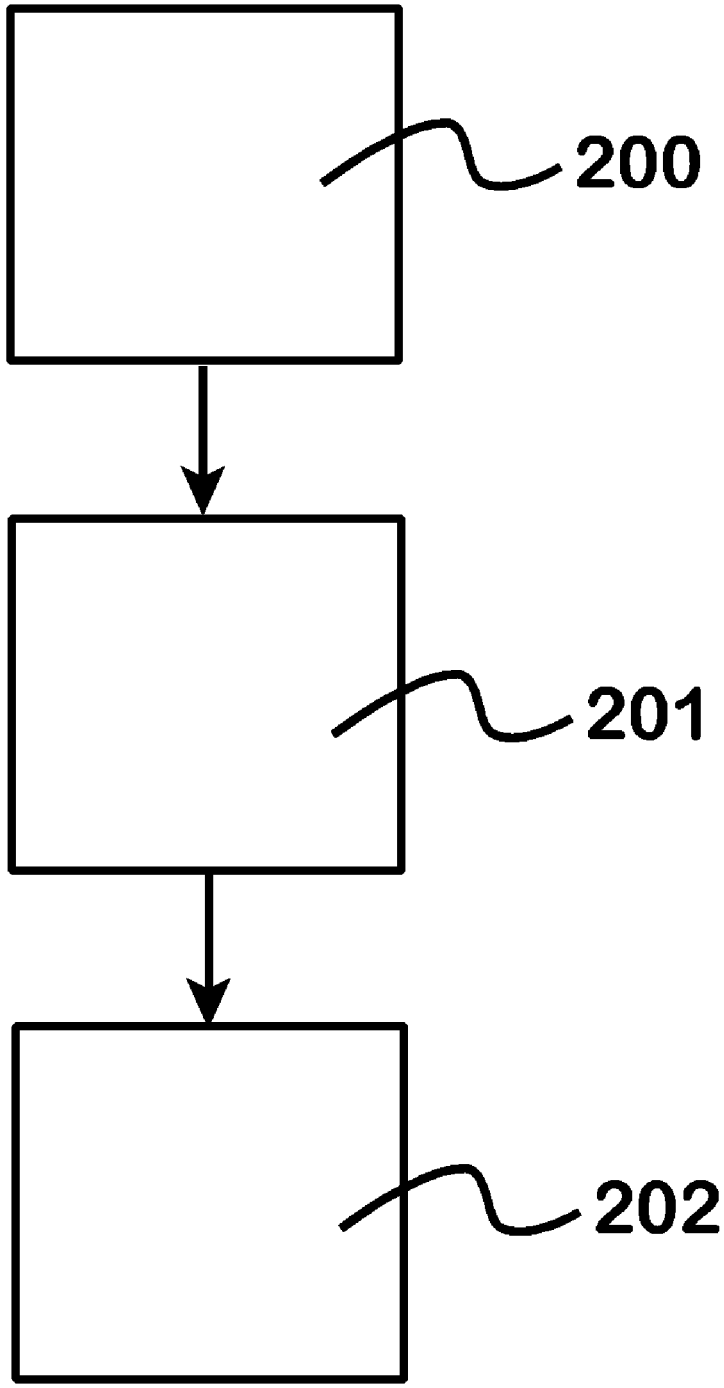
FIG. 1A shows a block diagram of a keg filling plant.

FIG. 1A shows a block diagram of a keg filling plant. Generally, a keg filling plant has a cleaning machine or system 200, a filling machine or system 201, and a packaging machine or system 202. In operation, the empty kegs are cleaned in the cleaning machine 200 and then transported to the filling machine 201. The kegs are then filled in the filling machine 201 and then sent to the packaging machine 202. There the kegs are packaged in groups for transport to warehouses, distribution centers, etc.

In practice, two types of fittings have acquired a particular significance. These fittings are called flat fittings and basket fittings. Some flat fittings and basket fittings which may possibly be used in at least one possible embodiment are made by RUDAT GmbH, located at Zollbergerstrasse 27, D-73734 Esslingen, Federal Republic of Germany, and located on the internet at www.rudat.com.

Figure 2:
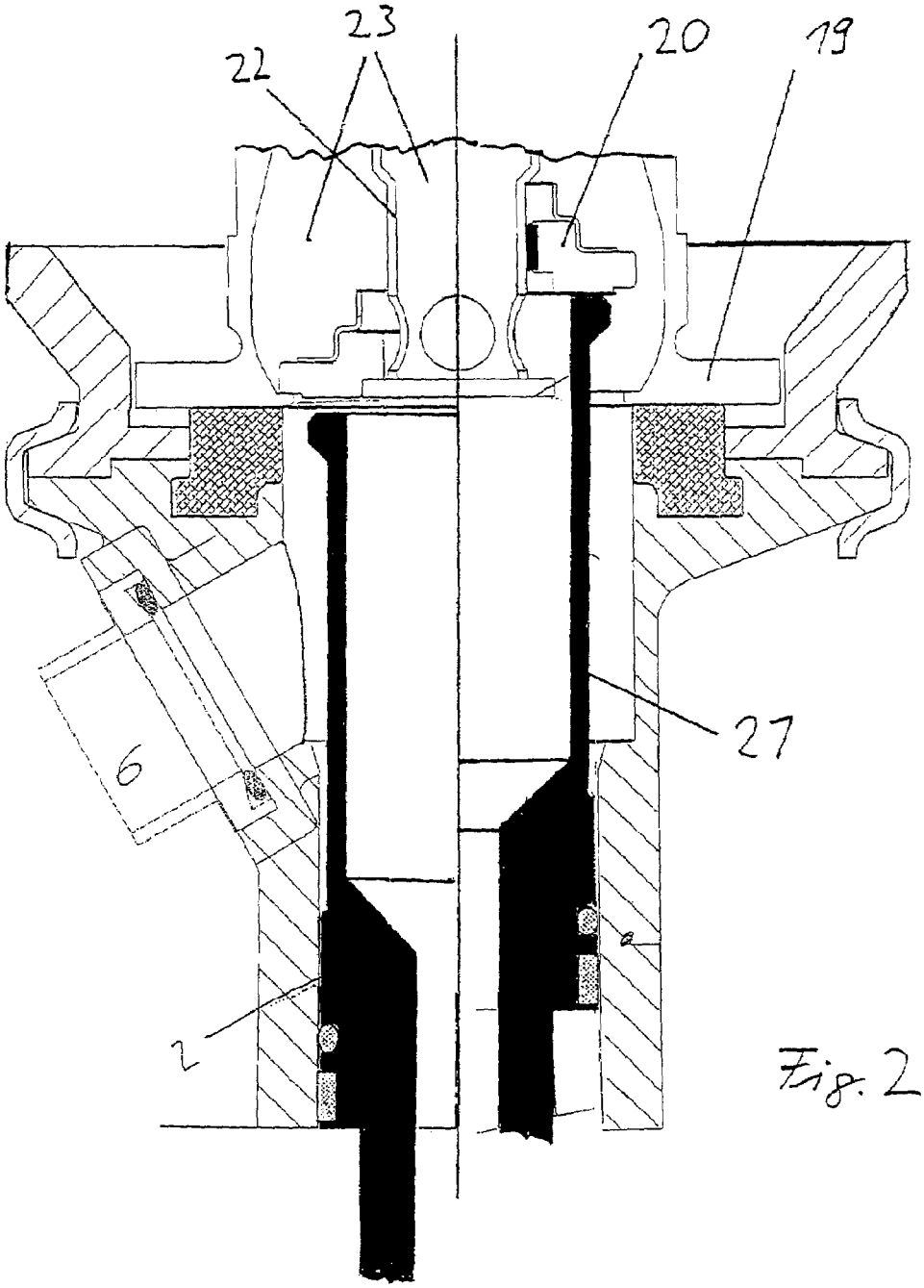
FIG. 2 is a simplified drawing in section of a handling head for flat fittings that is part of the prior art.

The flat fitting 19 illustrated in FIG. 2 has essentially a plate-shaped or disc-shaped configuration, whereby it contains a movable valve 20 in the shape of a circular ring. This valve 20 is actuated by a hollow cup plunger 21 which enters into a sealed connection with the valve 20 and simultaneously establishes the media connections to the filler tube 22 and the keg interior 23. The procedure is clearly illustrated in FIG. 2, whereby the left half of FIG. 2 shows the closed position and the right half an open position.

Figure 3:
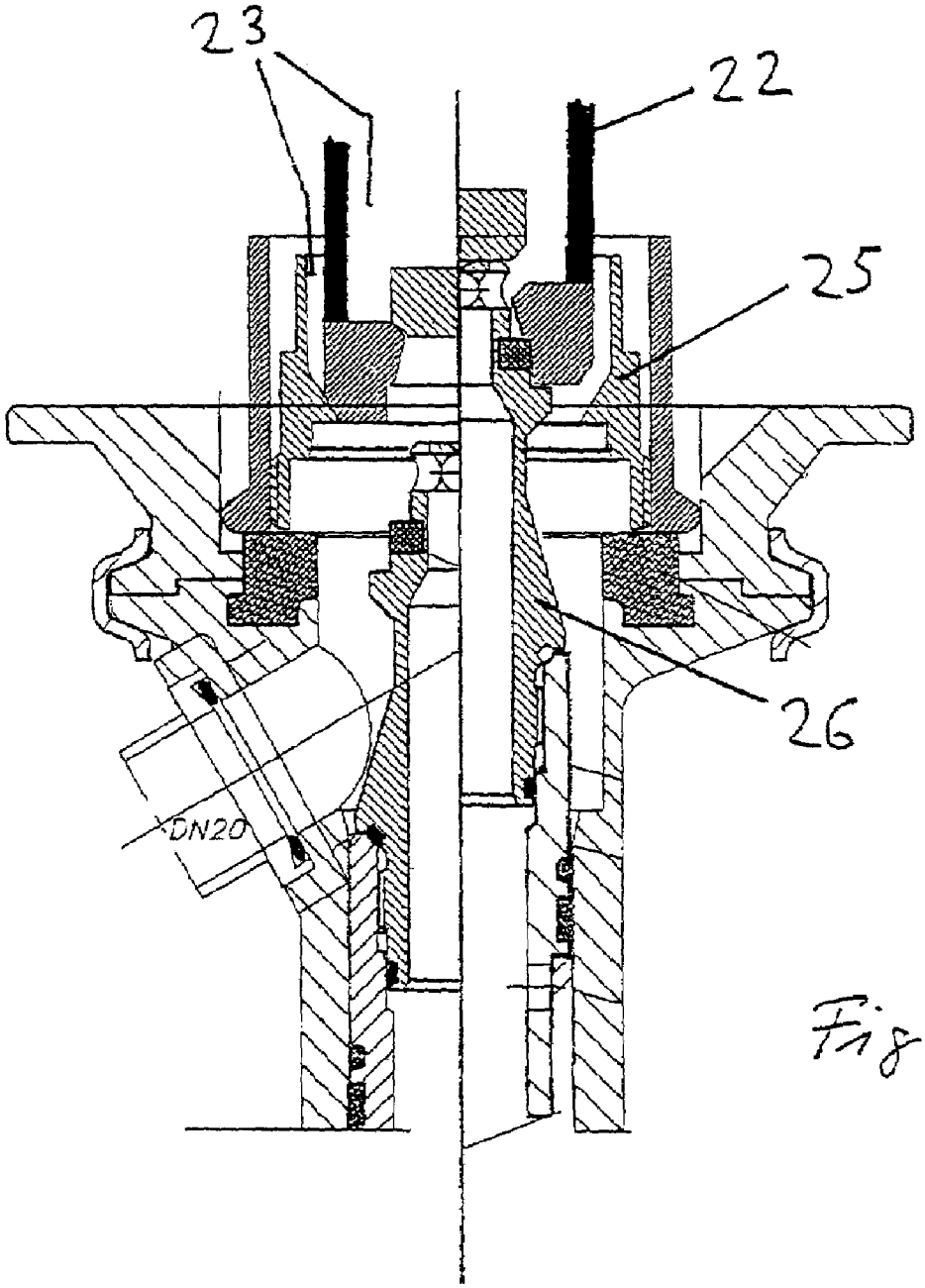
FIG. 3 is also a simplified drawing in section of a handling head for basket fittings that is part of the prior art.

The basket fitting 25 illustrated in FIG. 3 has the form of a plurality of circular rings located inside a cylinder, whereby in the middle of these circular rings there is a closing element in the shape of a circular ring. When the basket fitting 25 is used, the circular closing element and the innermost circular ring form the moving valve elements. These elements are raised and actuated by a graduated plunger 26, as a result of which the connections to the keg interior 23 are established.

At least one possible embodiment then teaches that the handling head can be realized so that it can be used to handle both kegs with flat fittings of the type described above as well as kegs with basket fittings of the type also described above. For this purpose, associated with a handing head 18 are actuator elements which can enter into a functional connection with different types of fittings.

Figure 4:
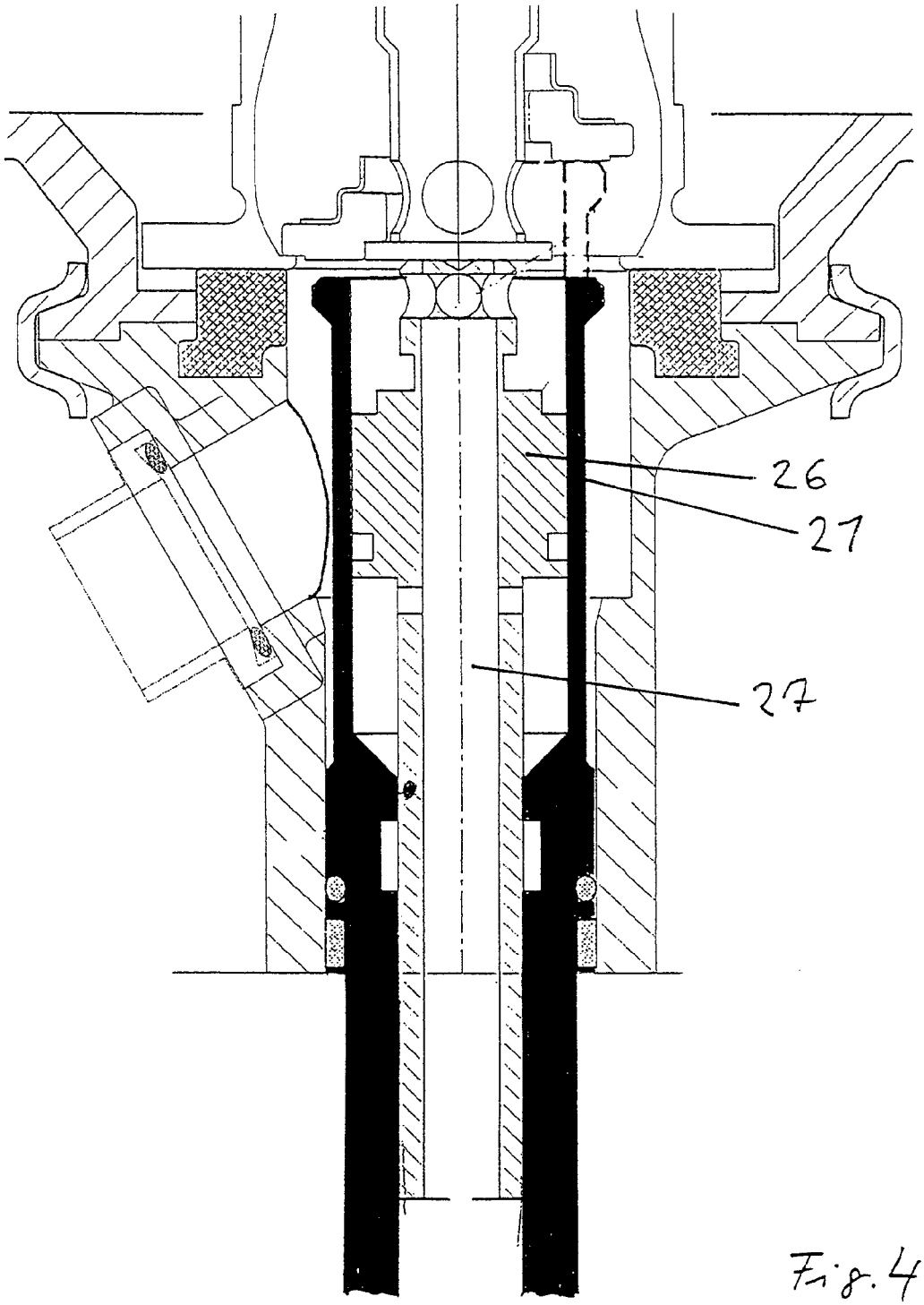
FIG. 4 is a handling head according to at least one possible embodiment with plungers (21, 26) that can move independently of each other.

As shown in the exemplary embodiment illustrated in FIG. 4, a handling head 18 according to at least one possible embodiment has both an element for the actuation of flat fittings 19, for example a cup plunger 21, as well as an element for the actuation of basket fittings 25, for example a graduated plunger 26. Both the cup plunger 21 and the graduated plunger 26 are realized so that they are essentially rotationally symmetrical, whereby both have a media line 27 in their interior. In one particularly advantageous configuration, the graduated plunger 26 is located inside the cup plunger 21. The two elements can thereby be moved independently of each other so that they can each execute a reciprocating movement uninfluenced by the other element to open the respective fitting type. The application likewise teaches that these reciprocating movements are executed by independent drive systems.

FIG. 4 illustrates, by way of example, a situation in which a flat fitting 19 is associated with the handling head 18. Initially both the cup plunger 21 as well as the graduated plunger 26 are in a non-engaged position. To initiate the process of handling and treating the kegs, the cup plunger 21 is lifted while the graduated plunger 26 remains in a non-engaged position. As shown by the broken line in the right half of FIG. 4, the upper edge of the cup plunger 21 actuates the circular ring-shaped valve 20 of the flat fitting and thereby opens the media connections to or from the keg. After the handling and treatment process has been completed, the cup plunger 21 moves back into the non-engaged position, as a result of which the plate-shaped valve 20 is closed again. If the handling head 18 is then associated with a basket fitting, the handling phase is thereby initiated by moving the graduated plunger 26 out of the non-engaged position into the engaged position, whereby the cup plunger 21 remains in the non-engaged position. The valve elements are thereby opened analogous to the illustrations in FIG. 3, and are closed again after the handling process has been completed.

In an additional and altogether advantageous possible embodiment, the handling head 18 and/or the handling and treatment station can be equipped with a recognition module which is capable of automatically recognizing the keg and/or fitting type of the kegs that are about to be handled, and to activate the corresponding plunger for the subsequent handling and treatment of the kegs.

Figure 7:
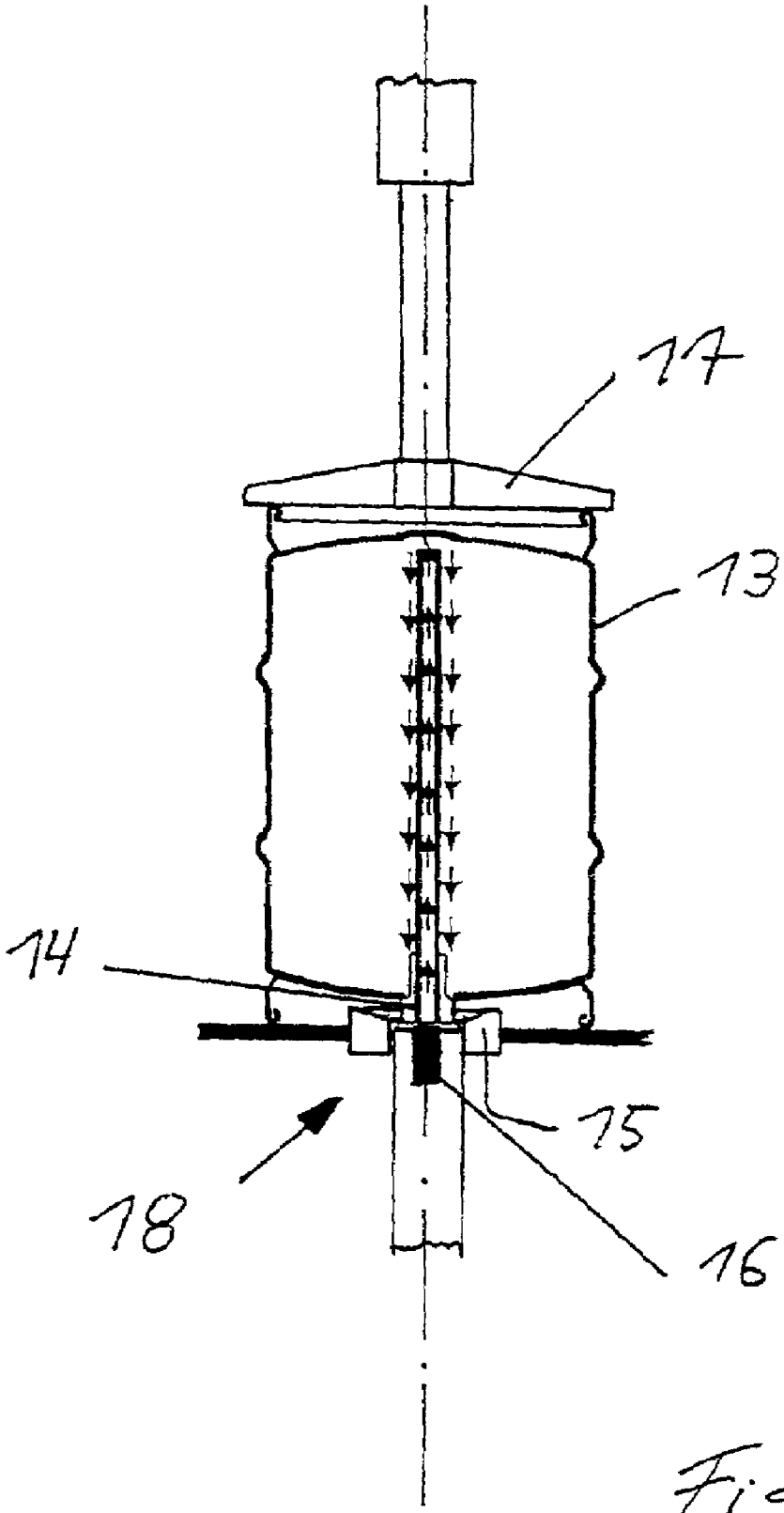
FIG. 7 is a block diagram showing an RFID transponder system in accordance with at least one possible embodiment.

Because numerous kegs 100 are equipped with RFID transponders 101, as shown in FIG. 7, which, among other things, have also stored the fitting type directly or indirectly as computer-readable information, when such a module is used, for example, the module can be, for example, a transponder unit with a downstream evaluation and activation device. FIG. 7 shows a control unit 102 that receives the data signal from the RFID transponder 101. The control unit 102 thereby identifies the fitting type of the keg 100 and uses this information to operate an adjuster or actuator system 103 that operates the appropriate machinery for the specific fitting type.

Figure 8:
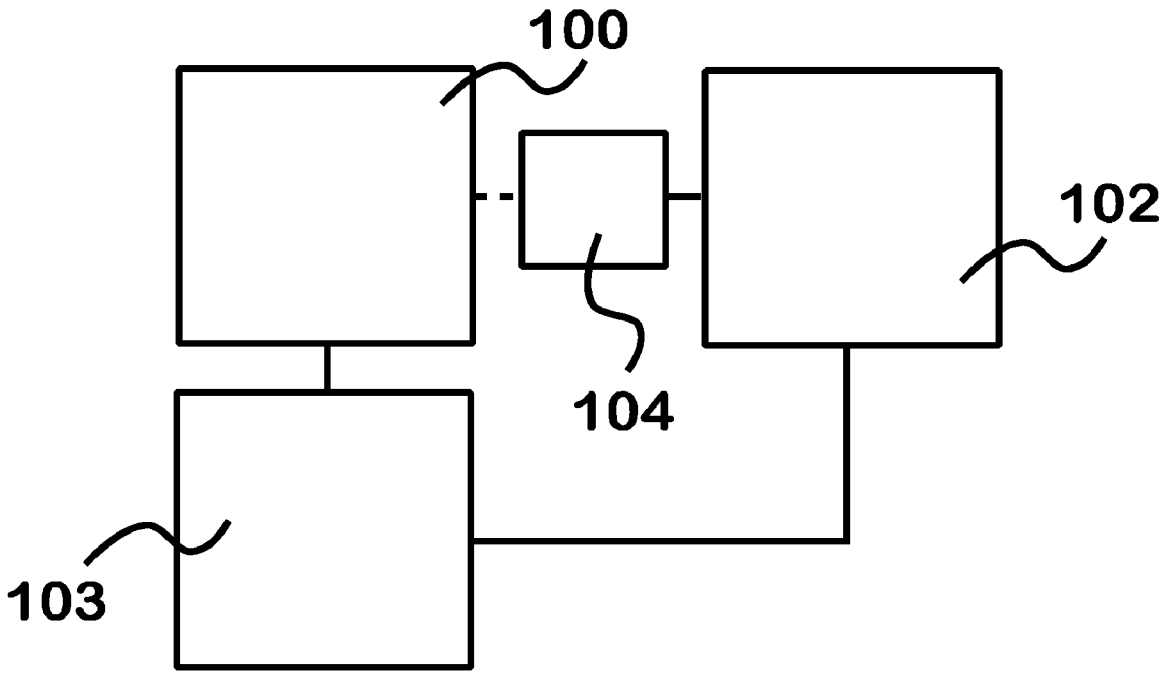
FIG. 8 is a block diagram showing a sensor system in accordance with at least one possible embodiment.

Other types of modules can also be used, e.g. sensors that operate mechanically or optically, or even camera systems with downstream computer-assisted image processing. With this method, it thereby becomes possible for the first time to process kegs with different fitting types in mixed and unorganized series in a single bottling plant, which has particular advantages with regard to the flexibility of operation and the return on the investment in the bottling plant. FIG. 8 shows sensors or sensor arrangements or camera systems 104, which sense, detect, and/or monitor the kegs 100 to detect the appropriate fitting type on the kegs. The sensor arrangement 104 is connected to the control unit 102 to provide the information regarding the fitting type of each keg 100. The control unit 102 thereby identifies the fitting type of the keg 100 and uses this information to operate the adjuster or actuator system 103 that operates the appropriate machinery for the specific fitting type.

Figure 5:
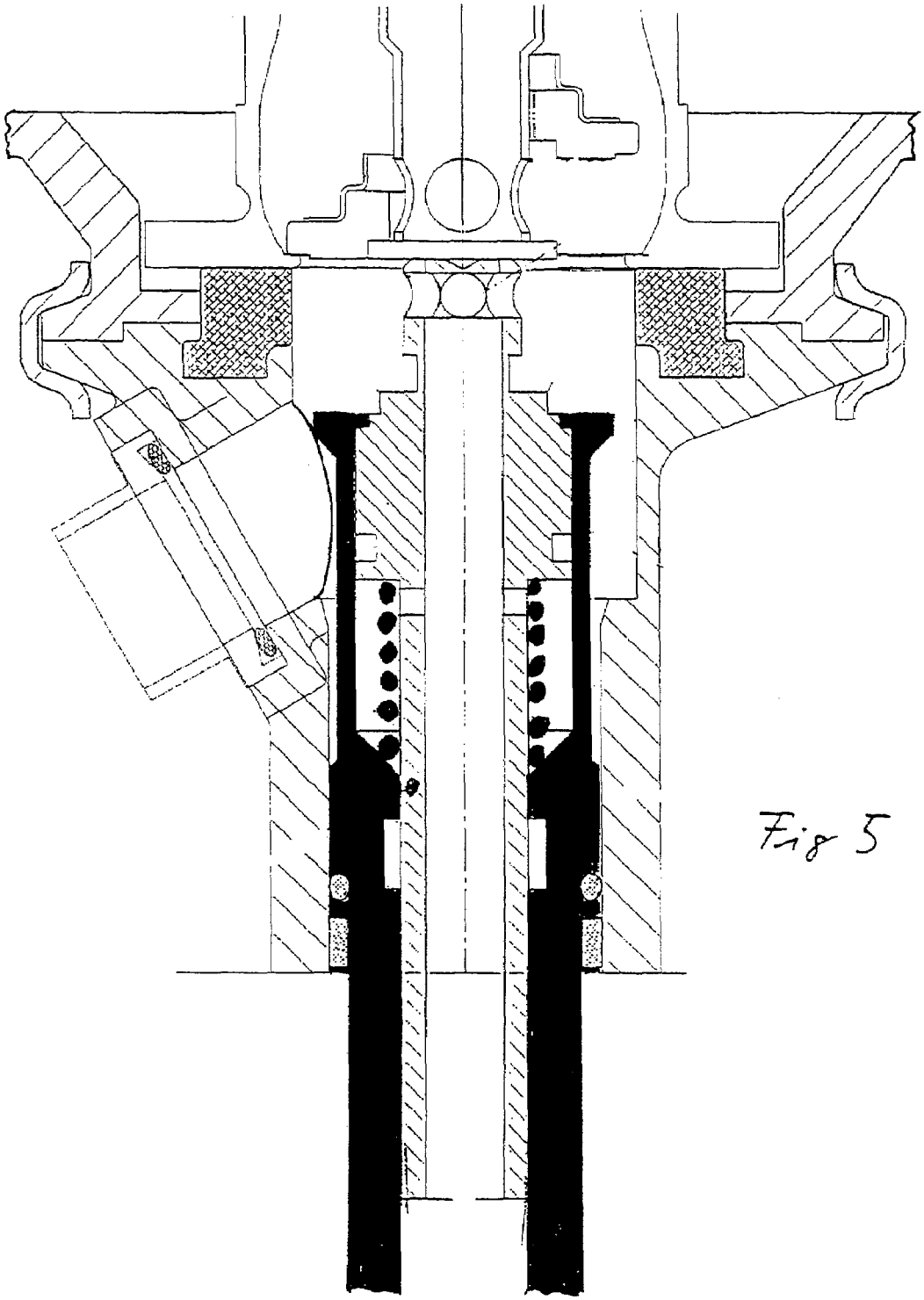
FIG. 5 is a handling head according to at least one possible embodiment with plungers (21, 26) that do not move independently of each other.
Figure 5A:
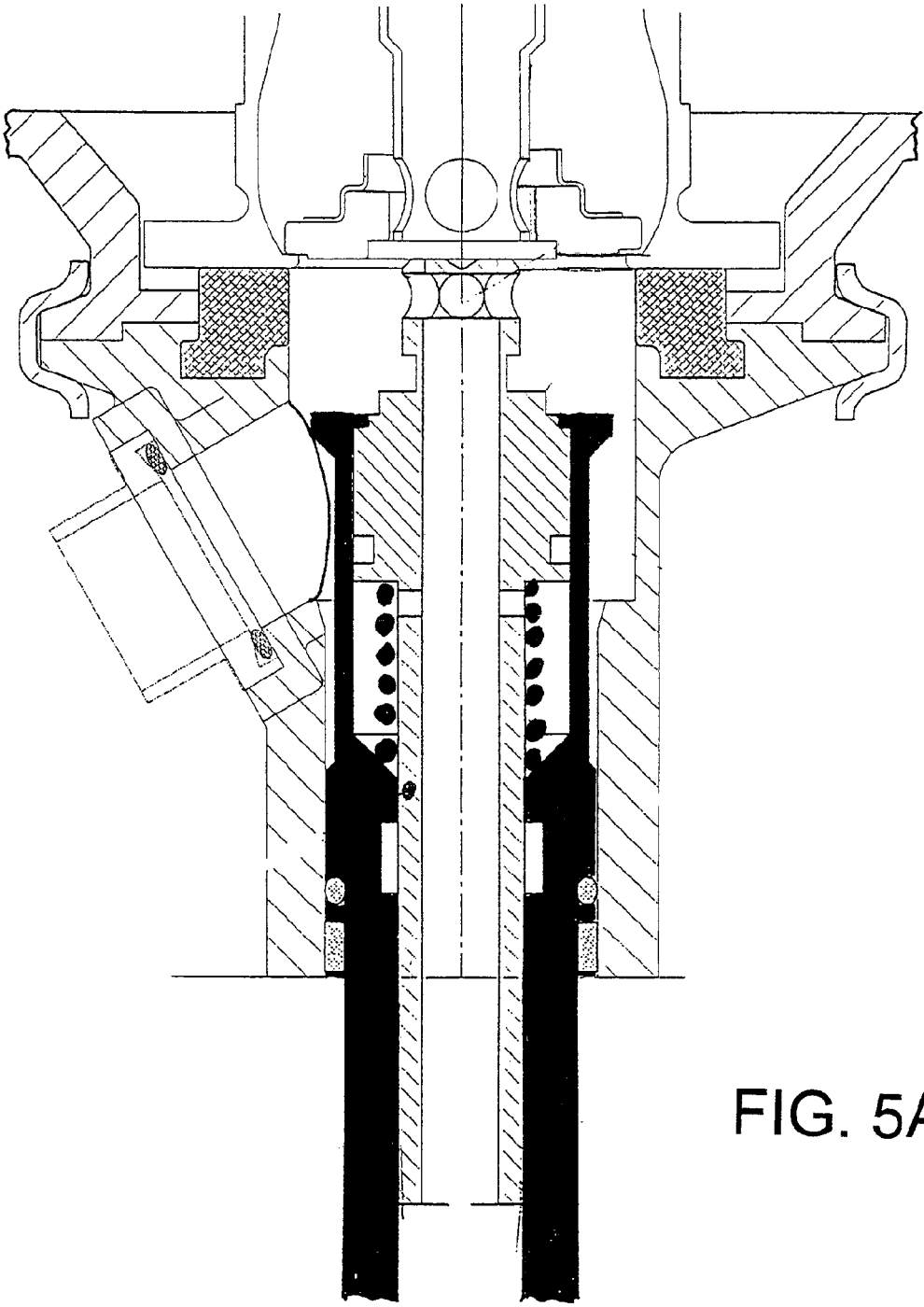

In the context of an additional configuration, as illustrated in FIG. 5, the graduated plunger 26 and the cup plunger 21 are arranged with respect to each other so that the graduated plunger 26 projects beyond the upper edge of the cup plunger 26. The graduated plunger 26 is thereby moved, for example by the force of a spring, with respect to the cup plunger 21 which is held in this raised position, whereby the spring can be braced, for example, on or in the cup plunger. During the opening of basket fittings, the graduated and cup plungers 26, 21 move jointly into the engaged position, the graduated plunger 26 opens the valves, without the cup plunger that moves with it having any negative influence on this process. If a flat fitting 18 is to be handled next, first both plungers are moved out of the non-engaged position. After moving a determined distance, the graduated plunger 26 comes into contact with the non-moving middle part of the fitting and can therefore not continue its upward movement. The cup plunger 26, on the other hand, travels further upward and opens the valve 20 which is in the shape of a circular ring. As a result of this altogether advantageous process, a separate drive for the graduated plunger and the recognition module is unnecessary, without thereby preventing the mixed processing of different types of fittings.

In a further independent realization of at least one possible embodiment, the centering devices 15 of the prior art, which must also be adapted to the different external dimensions of the various types of fittings, and therefore on devices of the prior art must be changed when the type of fitting changes, can also be replaced by a universal device.

Figure 6:
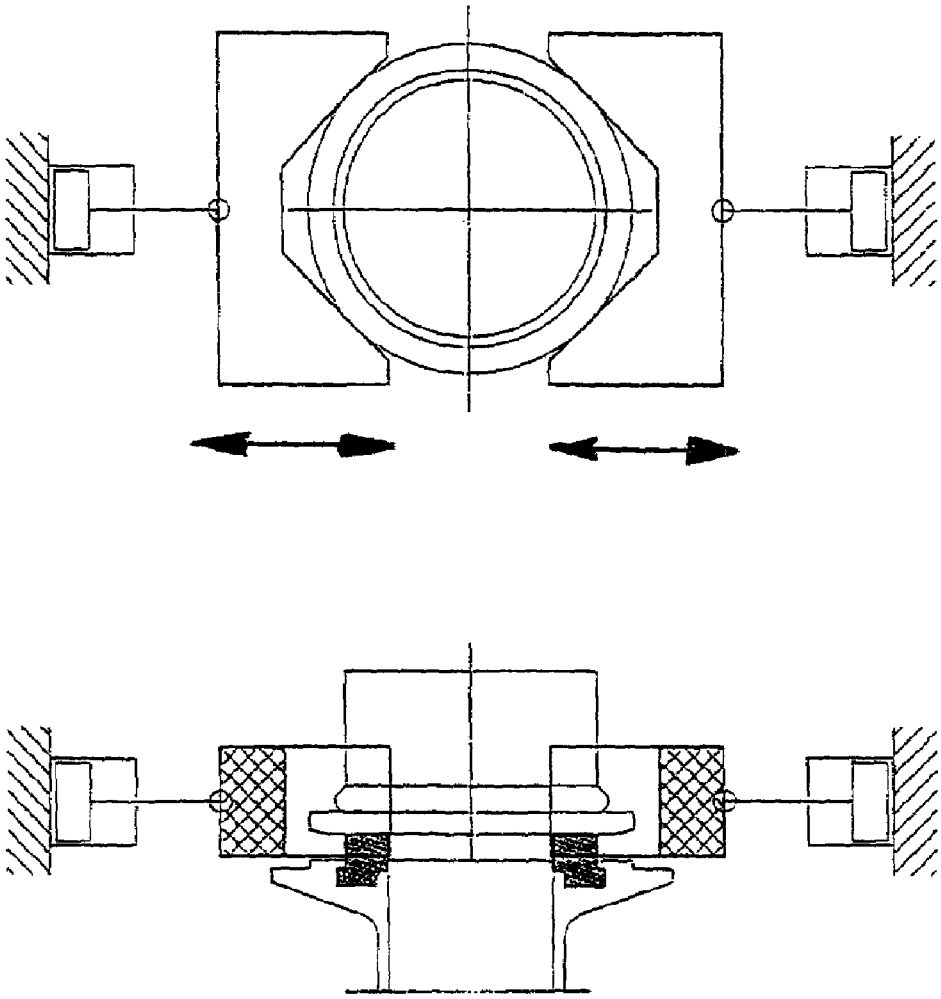
FIG. 6 is a schematic drawing of an adjustable centering device (15)
Figure 7:
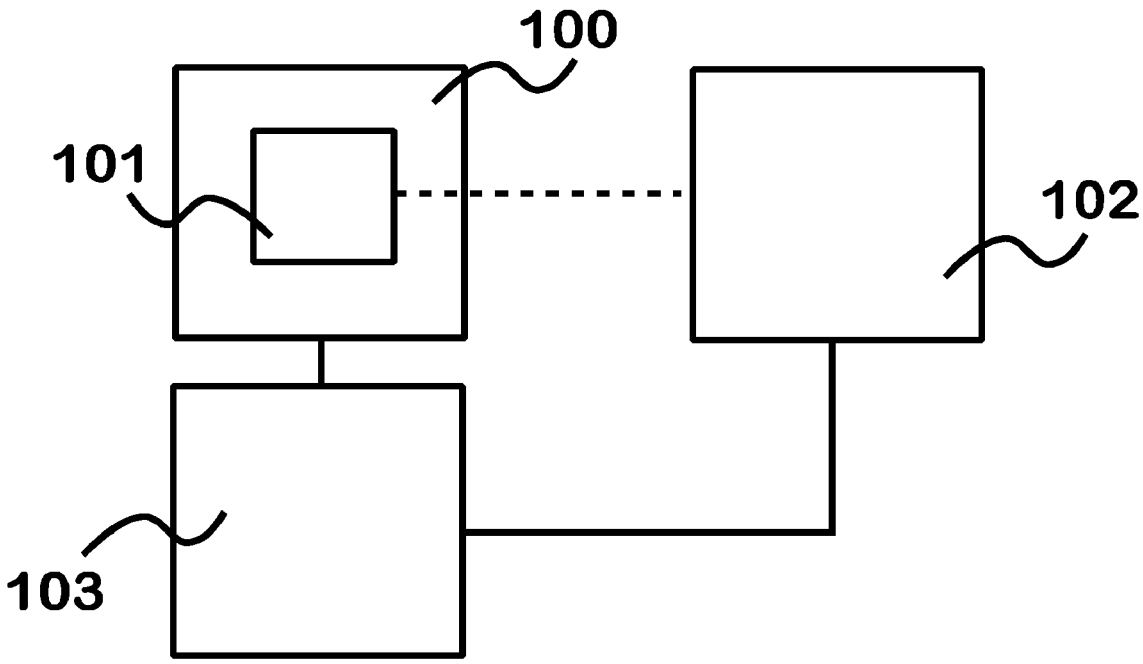

By way of example, FIG. 6 shows a centering element which consists of two elements having a prismatic receptacle, whereby these elements can be moved in a controlled manner toward each other, as a result of which these elements can center fitting types with different (outside) dimensions.

The application also teaches that these centering elements can be set or adjusted automatically as a function of the type of fitting identified by the above referenced recognition module.

One feature or aspect of an embodiment is believed at the time of the filing of this patent application to possibly reside broadly in a handling and treatment station for the handling or filling of the interiors of kegs that are equipped with fittings, with an applicator element 17, a handling head 18, with a centering device 15 and feed and discharge lines for handling and treatment media and/or the liquid being bottled and at least one actuator element for the valve element or elements of the fittings, wherein the at least one actuator element is realized so that both flat-type and basket-type fittings 19, 25 can be opened and connected with the delivery and/or discharge lines.

Another feature or aspect of an embodiment is believed at the time of the filing of this patent application to possibly reside broadly in the handling and treatment station, wherein the handling head 18 comprises at least two plungers 21, 26 which can be moved independently of each other.

Yet another feature or aspect of an embodiment is believed at the time of the filing of this patent application to possibly reside broadly in the handling and treatment station, wherein the handling head 18 has at least two plungers 21, 26 which cannot be moved independently of each other.

Still another feature or aspect of an embodiment is believed at the time of the filing of this patent application to possibly reside broadly in the handling and treatment station, wherein a first exterior plunger 21 is realized so that it holds a second, interior plunger 26 and moves forward with it, whereby the first plunger 21 is further realized so that the second plunger 26, when it comes into contact against a stationary element and thus can no longer track the continued forward movement of the first plunger 21, can be plunged into the first plunger 21.

A further feature or aspect of an embodiment is believed at the time of the filing of this patent application to possibly reside broadly in the handling and treatment station, wherein the first outer and second inner plungers 21, 26 are realized so that their sealing surfaces move relative to each other when the second inner plunger 26 can no longer track an upward movement as a result of its contact with a stationary element.

Another feature or aspect of an embodiment is believed at the time of the filing of this patent application to possibly reside broadly in the handling and treatment station, wherein the centering device 15 is realized so that it can be adapted to the outside diameter of different fittings.

Yet another feature or aspect of an embodiment is believed at the time of the filing of this patent application to possibly reside broadly in the handling and treatment station, wherein the centering device 15 is adapted by the adjustment of at least two centering elements.

Still another feature or aspect of an embodiment is believed at the time of the filing of this patent application to possibly reside broadly in the handling and treatment station, wherein at least one recognition module for the type of fitting is associated with the handling and treatment station and/or the handling head 18.

A further feature or aspect of an embodiment is believed at the time of the filing of this patent application to possibly reside broadly in the handling and treatment station, wherein the recognition module is a computer-assisted image processing system or optically or mechanically functioning sensors.

Another feature or aspect of an embodiment is believed at the time of the filing of this patent application to possibly reside broadly in a method for the operation of a keg handling and treatment plant, wherein the plunger 21, 26 to be activated is specified by the user in advance for the entire handling and treatment plant, or the plunger 21,26 to be activated is automatically recognized and activated by a recognition module for each handling and treatment station for the keg currently being handled.

Yet another feature or aspect of an embodiment is believed at the time of the filing of this patent application to possibly reside broadly in a handling and treatment station for the handling or filling of the interiors of kegs that are equipped with fittings, with an applicator element, a handling head, with a centering device and feed and discharge lines for handling and treatment media and/or the liquid being bottled and at least one actuator element for the valve element or elements of the fittings, whereby the application teaches that the at least one actuator element is realized so that both flat-type and basket-type fittings can be opened and connected with the delivery and/or discharge lines.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

The appended drawings in their entirety, including all dimensions, proportions and/or shapes in at least one embodiment of the invention, are accurate and are hereby included by reference into this specification.

Some examples of open-loop control systems that may possibly be utilized or possibly adapted for use in at least one possible embodiment of the present application may possibly be found in the following U.S. patents: No. U.S. Pat. No. 5,770,934 issued to Theile on Jun. 23, 1998; U.S. Pat. No. 5,210,473 issued to Backstrand on May 11, 1993; U.S. Pat. No. 5,320,186 issued to Strosser et al. on Jun. 14, 1994; and U.S. Pat. No. 5,369,342 issued to Rudzewicz et al. on Nov. 29, 1994.

Some examples of closed-loop control systems that may possibly be utilized or possibly adapted for use in at least one possible embodiment of the present application may possibly be found in the following U.S. patents: U.S. Pat. No. 5,770,934 issued to Theile on Jun. 23, 1998; U.S. Pat. No. 5,189,605 issued to Zuehlke et al. on Feb. 23, 1993; U.S. Pat. No. 5,223,072 issued to Brockman et al. on Jun. 29, 1993; and U.S. Pat. No. 5,252,901, issued to inventors Ozawa et al. on. Oct. 12, 1993.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of cameras or the like optical monitoring apparatus that may possibly be utilized or possibly adapted for use in at least one possible embodiment of the present application may possibly be found in the following U.S. patents: U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

All, or substantially all, of the components and methods of the various embodiments may be used with at least one embodiment or all of the embodiments, if more than one embodiment is described herein.

Some examples of RFID devices, systems, and components thereof which may possibly be used in at least one possible embodiment may possibly be found in the following U.S. Pat. Nos.: U.S. Pat. No. 7,069,251, entitled "RFID transponder dispenser and authorizer"; U.S. Pat. No. 7,068,170, entitled "RFID embedded materials"; U.S. Pat. No. 7,066,667, entitled "RFID tag and printer system"; U.S. Pat. No. 7,066,388, entitled "System and method for verifying RFID reads"; U.S. Pat. No. 7,059,518, entitled "RFID device detection system and method"; U.S. Pat. No. 7,057,562, entitled "RFID device with patterned antenna, and method of making"; U.S. Pat. No. 7,057,511, entitled "Method, system, and apparatus for communicating with a RFID tag population"; U.S. Pat. No. 7,055,753, entitled "RFID device tester and method"; U.S. Pat. No. 7,054,595, entitled "Systems and methods for amplifying a transmit signal in a RFID interrogator"; U.S. Pat. No. 7,053,777, entitled "Interrogation, monitoring and data exchange using RFID tags"; U.S. Pat. No. 7,053,775, entitled "RFID material tracking method and apparatus"; U.S. Pat. No. 7,049,964, entitled "RFID readers and tags transmitting and receiving waveform segment with ending-triggering transition"; U.S. Pat. No. 7,048,183, entitled "RFID rag and method of user verification"; U.S. Pat. No. 7,045,186, entitled "RFID manufacturing concepts"; U.S. Pat. No. 7,044,387, entitled "RFID tag and communication protocol for long range tag communications and power efficiency"; and U.S. Pat. No. 7,042,358, entitled "RFID material tracking method and apparatus."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign patent publication applications, namely, Federal Republic of Germany Patent Application No. 10 2005 031 573.9, filed on Jul. 6, 2005, having inventor Alois MONZEL, and DE-OS 10 2005 031 573.9 and DE-PS 10 2005 031 573.9, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of operating a keg filling plant for filling both kegs having flat fittings and kegs having basket fittings with a liquid beverage, such as beer, wine, soft drinks, or juice, each of said kegs comprising:

a hollow, substantially cylindrical housing having a first end and second end opposite said first end;

a fitting being disposed in said first end of said housing;

an elongated filler tube comprising a first end mounted on or connected to said fitting and a second end disposed opposite said first end and adjacent said second end of said housing;

said filler tube being configured to conduct cleaning media into the interior of said housing during cleaning of the interior of said housing and to permit exit of gas from the interior of said housing during filling of the interior of said housing with a filling liquid;

said fitting comprising one of (A) and (B):

(A) a flat fitting comprising a ring-shaped movable valve element disposed about said first end of said filler tube;

said ring-shaped movable valve element being configured to be axially moved away from said first end of said housing on and along a portion of said filler tube to open said keg to permit access to the interior of said housing to permit cleaning of the interior or filling of the interior with a filling liquid;

(B) a basket fitting comprising a movable valve element disposed on the tip of said first end of said filler tube;

said movable valve element being configured to be axially moved away from said first end of said housing to open said keg to permit access to the interior of said housing to permit cleaning of the interior or filling of the interior with a filling liquid;

said keg filling plant comprising:

a cleaning arrangement being configured and disposed to clean empty kegs;

a filling arrangement being configured and disposed to fill cleaned, empty kegs with a filling liquid;

said cleaning arrangement comprising:

a handling apparatus being configured and disposed to handle a keg to be cleaned;

said handling apparatus comprising a centering device being configured and disposed to center a keg in said handling apparatus;

feed and discharge lines being configured and disposed to permit the delivery and removal of cleaning media into and out of a keg;

an actuator element being configured and disposed to move a movable valve element of a fitting of a keg to permit entry and exit of cleaning media into and out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting;

a second plunger comprising an elongated body being configured to be axially moved to engage and move a movable valve element disposed on a tip end of a keg filler tube in a keg to open a keg with a basket fitting; and at least a portion of said second plunger being disposed within said substantially cylindrical body of said first plunger; and said filling arrangement comprising:

a handling apparatus being configured and disposed to handle a keg to be filled;

said handling apparatus comprising a centering device being configured and disposed to center a keg in said handling apparatus;

feed lines being configured and disposed to permit filling of a keg with filling liquid;

gas lines being configured and disposed to permit flow of gas out of a keg being filled with filling liquid;

an actuator element being configured and disposed to move a movable valve element of a fitting of a keg to permit entry of filling liquid into a keg and exit of gas out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting;

a second plunger comprising an elongated body being configured to be axially moved to engage and move a movable valve element disposed on a tip end of a keg filler tube in a keg to open a keg with a basket fitting; and at least a portion of said second plunger being disposed within said substantially cylindrical body of said first plunger; and said method comprising the steps of:

moving a first keg comprising a flat fitting into said cleaning arrangement and cleaning the interior of the first keg;

said step of cleaning the interior of the first keg comprising:

centering the first keg with said centering device in said handling apparatus;

engaging and moving said movable valve element of the first keg with said first plunger to open the first keg;

transporting cleaning media through said feed lines, said flat fitting, and said filler tube into the interior of the first keg to clean the interior of the first keg; and removing said cleaning media out of the first keg through said flat fitting and said discharge lines;

disengaging said first plunger of said cleaning arrangement from said movable valve element of the first keg to permit said movable valve element to close the first keg upon completion of cleaning of the interior of the first keg;

moving the first keg out of said cleaning arrangement and into said filling arrangement;

filling the interior of the first keg with a filling liquid, said step of filling the interior of the first keg comprising:

centering the first keg with said centering device in said handling apparatus;

engaging and moving said movable valve element of the first keg with said first plunger to open the first keg;

flowing filling liquid through said feed lines and said flat fitting into the interior of the first keg, and substantially simultaneously flowing gas through said filler tube, said flat fitting, and said gas lines out of the interior of the first keg; and terminating filling upon the filling liquid reaching the second end of said filler tube; and disengaging said first plunger of said filling arrangement from said movable valve element of the first keg to permit said movable valve element to close the first keg upon completion of filling of the interior of the first keg with a filling liquid;

said method further comprising the steps of:

moving a second keg comprising a basket fitting into said cleaning arrangement and cleaning the interior of the second keg;

said step of cleaning the interior of the second keg comprising:

centering the second keg with said centering device in said handling apparatus;

engaging and moving said movable valve element of the second keg with said second plunger to open the second keg;

transporting cleaning media through said feed lines, said basket fitting, and said filler tube into the interior of the second keg to clean the interior of the second keg; and removing said cleaning media out of the second keg through said basket fitting and said discharge lines;

disengaging said second plunger of said cleaning arrangement from said movable valve element of the second keg to permit said movable valve element to close the second keg upon completion of cleaning of the interior of the second keg;

moving the second keg out of said cleaning arrangement and into said filling arrangement;

filling the interior of the second keg with a filling liquid, said step of filling the interior of the second keg comprising:

centering the second keg with said centering device in said handling apparatus;

engaging and moving said movable valve element of the second keg with said second plunger to open the second keg;

flowing filling liquid through said feed lines and said basket fitting into the interior of the second keg, and substantially simultaneously flowing gas through said filler tube, said basket fitting, and said gas lines out of the interior of the second keg; and terminating filling upon the filling liquid reaching the second end of said filler tube; and disengaging said second plunger of said filling arrangement from said movable valve element of the second keg to permit said movable valve element to close the second keg upon completion of filling of the interior of the second keg with a filling liquid.

2. The method according to claim 1, wherein:

said centering device comprises at least two centering elements configured to be adjusted to adapt said centering device to the outside diameter of different fittings;

said first plunger is configured to be moved independently of said second plunger in each of said cleaning and filling arrangements;

said second plunger is configured to be moved independently of said first plunger in each of said cleaning and filling arrangements;

said step of engaging and moving said movable valve element of the first keg with said first plunger to open the first keg comprises moving said first plunger independently of said second plunger;

said step of engaging and moving said movable valve element of the second keg with said second plunger to open the second keg comprises moving said second plunger independently of said first plunger; and at least one of (A) and (B):

(A) said keg filling plant further comprises a control system configured to receive input commands from a user to control at least the plungers of said cleaning and filling arrangements; and said method further comprises manually selecting, by input of the selection commands into said control system by a user, one of said first plunger and said second plunger to be activated in each of said cleaning and filling arrangements according to the type of fitting of the kegs to be cleaned and filled; and (B) each of the kegs comprises an identification device which corresponds to the type of fitting in the keg;

said keg filling plant comprises at least one recognition module configured to detect the keg identification devices to determine the type of fitting for each keg prior to cleaning and filling of the keg;

said at least one recognition module comprises a computer-assisted image processing system or optically or mechanically functioning sensors; and said method further comprises the step of automatically selecting, by detecting the keg identification device with said at least one recognition module, one of said first plunger and said second plunger to be activated in each of said cleaning and filling arrangements according to the type of fitting of the kegs to be cleaned and filled.

3. The method according to claim 1, wherein:

said centering device comprises at least two centering elements configured to be adjusted to adapt said centering device to the outside diameter of different fittings;

said first plunger is configured to be moved in conjunction with said second plunger in each of said cleaning and filling arrangements;

said second plunger is configured and disposed to be plunged into said first plunger upon said second plunger contacting a stationary element of said flat fitting upon axial movement of both of said plungers together;

said first plunger and said second plunger each comprise sealing surfaces configured to be moved relative to each other upon said second plunger contacting a stationary element of said flat fitting upon axial movement of both of said plungers together;

said step of engaging and moving said movable valve element of the second keg with said second plunger to open the second keg comprises moving both said second plunger and said first plunger together; and said step of engaging and moving said movable valve element of the first keg with said first plunger to open the first keg comprises:

moving both said first plunger and said second plunger together;

contacting said first end of said filler tube with said elongated body of said second plunger and plunging said second plunger into said first plunger as said first plunger continues moving axially; and engaging and moving said movable valve element of the first keg with said first plunger.

4. A keg filling plant for filling both kegs having flat fittings and kegs having basket fittings, with a liquid beverage, such as beer, wine, soft drinks, or juice, said keg filling plant comprising:

a cleaning machine being configured and disposed to clean empty kegs;

a filling machine being configured and disposed to fill cleaned, empty kegs with a liquid beverage;

a first conveyor arrangement being configured and disposed to convey kegs from said cleaning machine to said filling machine;

said cleaning machine comprising:

a handling head being configured and disposed to support a keg thereon;

said handling head comprising a centering device being configured and disposed to center a keg on said handling head;

an applicator element being configured and disposed to apply a force to a keg on said handling head to press the keg into a sealing engagement with said handling head;

feed and discharge lines being configured and disposed to permit the delivery and removal of cleaning media into and out of a keg;

an actuator element being configured and disposed to move a movable valve element of a fitting of a keg to permit entry and exit of cleaning media into and out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting;

a second plunger comprising an elongated body being configured to be axially moved to engage and move a movable valve element disposed on a tip end of a keg filler tube in a keg to open a keg with a basket fitting; and at least a portion of said second plunger being disposed within said substantially cylindrical body of said first plunger; and said filling machine comprising:

a handling head being configured and disposed to support a keg thereon;

said handling head comprising a centering device being configured and disposed to center a keg on said handling head;

an applicator element being configured and disposed to apply a force to a keg on said handling head to press the keg into a sealing engagement with said handling head;

feed lines being configured and disposed to permit filling of a keg with liquid beverage;

gas lines being configured and disposed to permit flow of gas out of a keg being filled with liquid beverage;

an actuator element being configured and disposed to move a movable valve element of a fitting of a keg to permit entry of liquid beverage into a keg and exit of gas out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting;

a second plunger comprising an elongated body being configured to be axially moved to engage and move a movable valve element disposed on a tip end of a keg filler tube in a keg to open a keg with a basket fitting; and at least a portion of said second plunger being disposed within said substantially cylindrical body of said first plunger.

5. The keg filling plant according to claim 4, wherein:

said centering device comprises at least two centering elements configured to be adjusted to adapt said centering device to the outside diameter of different fittings;

said first plunger is configured to be moved independently of said second plunger in each of said cleaning and filling arrangements;

said second plunger is configured to be moved independently of said first plunger in each of said cleaning and filling arrangements; and at least one of (A) and (B):

(A) said keg filling plant further comprises a control system configured to receive input commands from a user to control at least the plungers of said cleaning and filling arrangements to permit manual selection, by input of the selection commands into said control system by a user, of one of said first plunger and said second plunger to be activated in each of said cleaning and filling arrangements according to the type of fitting of kegs to be cleaned and filled; and (B) said keg filling plant comprises at least one recognition module configured to detect keg identification devices in kegs which correspond to the type of fitting in the keg to determine the type of fitting for each keg prior to cleaning and filling of the keg; and said at least one recognition module comprises a computer-assisted image processing system or optically or mechanically functioning sensors.

6. The keg filling plant according to claim 4, wherein:

said centering device comprises at least two centering elements configured to be adjusted to adapt said centering device to the outside diameter of different fittings;

said first plunger is configured to be moved in conjunction with said second plunger in each of said cleaning and filling arrangements;

said second plunger is configured and disposed to be plunged into said first plunger upon said second plunger contacting a stationary element of a flat fitting upon axial movement of both of said plungers together; and said first plunger and said second plunger each comprise sealing surfaces configured to be moved relative to each other upon said second plunger contacting a stationary element of a flat fitting upon axial movement of both of said plungers together.

7. A method of operating a keg filling plant for filling both kegs having flat fittings and kegs having basket fittings with a filling liquid, each of said kegs comprising:

a hollow housing having a first side and second side opposite said first side;

a fitting being disposed in said first side of said housing;

an elongated filler tube comprising a first end mounted on or connected to said fitting and a second end disposed opposite said first end and adjacent said second end of said housing;

said filler tube being configured to conduct cleaning media into the interior of said housing during cleaning of the interior of said housing and to permit exit of gas from the interior of said housing during filling of the interior of said housing with a filling liquid;

said fitting comprising one of (A) and (B):

(A) a flat fitting comprising a ring-shaped movable valve element disposed about said first end of said filler tube;

said ring-shaped movable valve element being configured to be axially moved away from said first side of said housing on and along a portion of said filler tube to open said keg to permit access to the interior of said housing to permit cleaning of the interior or filling of the interior with a filling liquid;

(B) a basket fitting comprising a movable valve element disposed on the tip of said first end of said filler tube;

said movable valve element being configured to be axially moved away from said first side of said housing to open said keg to permit access to the interior of said housing to permit cleaning of the interior or filling of the interior with a filling liquid;

said keg filling plant comprising:

a cleaning arrangement being configured and disposed to clean empty kegs;

a filling arrangement being configured and disposed to fill cleaned, empty kegs with a filling liquid;

said cleaning arrangement comprising:

a handling apparatus being configured and disposed to handle a keg to be cleaned;

said handling apparatus comprising a centering device being configured and disposed to center a keg in said handling apparatus;

feed and discharge lines being configured and disposed to permit the delivery and removal of cleaning media into and out of a keg;

an actuator element being configured and disposed to move a movable valve element of a fitting of a keg to permit entry and exit of cleaning media into and out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting;

a second plunger comprising an elongated body being configured to be axially moved to engage and move a movable valve element disposed on a tip end of a keg filler tube in a keg to open a keg with a basket fitting; and said filling arrangement comprising:

a handling apparatus being configured and disposed to handle a keg to be filled;

said handling apparatus comprising a centering device being configured and disposed to center a keg in said handling apparatus;

feed lines being configured and disposed to permit filling of a keg with filling liquid;

gas lines being configured and disposed to permit flow of gas out of a keg being filled with filling liquid;

an actuator element being configured and disposed to move a movable valve element of a fitting of a keg to permit entry of filling liquid into a keg and exit of gas out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting; and a second plunger comprising an elongated body being configured to be axially moved to engage and move a movable valve element disposed on a tip end of a keg filler tube in a keg to open a keg with a basket fitting;

said method comprising the steps of:

moving a first keg comprising a flat fitting into said cleaning arrangement and cleaning the interior of the first keg;

said step of cleaning the interior of the first keg comprising:

centering the first keg with said centering device in said handling apparatus;

engaging and moving said movable valve element of the first keg with said first plunger to open the first keg;

transporting cleaning media through said feed lines, said flat fitting, and said filler tube into the interior of the first keg to clean the interior of the first keg; and removing said cleaning media out of the first keg through said flat fitting and said discharge lines;

disengaging said first plunger of said cleaning arrangement from said movable valve element of the first keg to permit said movable valve element to close the first keg upon completion of cleaning of the interior of the first keg;

moving the first keg out of said cleaning arrangement and into said filling arrangement;

filling the interior of the first keg with a filling liquid, said step of filling the interior of the first keg comprising:

centering the first keg with said centering device in said handling apparatus;

engaging and moving said movable valve element of the first keg with said first plunger to open the first keg;

flowing filling liquid through said feed lines and said flat fitting into the interior of the first keg, and substantially simultaneously flowing gas through said filler tube, said flat fitting, and said gas lines out of the interior of the first keg; and terminating filling upon the filling liquid reaching the second end of said filler tube; and disengaging said first plunger of said filling arrangement from said movable valve element of the first keg to permit said movable valve element to close the first keg upon completion of filling of the interior of the first keg with a filling liquid;

said method further comprising the steps of:

moving a second keg comprising a basket fitting into said cleaning arrangement and cleaning the interior of the second keg;

said step of cleaning the interior of the second keg comprising:

centering the second keg with said centering device in said handling apparatus;

engaging and moving said movable valve element of the second keg with said second plunger to open the second keg;

transporting cleaning media through said feed lines, said basket fitting, and said filler tube into the interior of the second keg to clean the interior of the second keg; and removing said cleaning media out of the second keg through said basket fitting and said discharge lines;

disengaging said second plunger of said cleaning arrangement from said movable valve element of the second keg to permit said movable valve element to close the second keg upon completion of cleaning of the interior of the second keg;

moving the second keg out of said cleaning arrangement and into said filling arrangement;

filling the interior of the second keg with a filling liquid, said step of filling the interior of the second keg comprising:

centering the second keg with said centering device in said handling apparatus;

engaging and moving said movable valve element of the second keg with said second plunger to open the second keg;

flowing filling liquid through said feed lines and said basket fitting into the interior of the second keg, and substantially simultaneously flowing gas through said filler tube, said basket fitting, and said gas lines out of the interior of the second keg; and terminating filling upon the filling liquid reaching the second end of said filler tube; and disengaging said second plunger of said filling arrangement from said movable valve element of the second keg to permit said movable valve element to close the second keg upon completion of filling of the interior of the second keg with a filling liquid.

8. The method according to claim 7, wherein:

said first plunger is configured to be moved independently of said second plunger in each of said cleaning and filling arrangements;

said second plunger is configured to be moved independently of said first plunger in each of said cleaning and filling arrangements;

said step of engaging and moving said movable valve element of the first keg with said first plunger to open the first keg comprises moving said first plunger independently of said second plunger; and said step of engaging and moving said movable valve element of the second keg with said second plunger to open the second keg comprises moving said second plunger independently of said first plunger.

9. The method according to claim 8, wherein at least a portion of said second plunger is disposed within said substantially cylindrical body of said first plunger.

10. The method according to claim 9, wherein:

said centering device comprises at least two centering elements configured to be adjusted to adapt said centering device to the outside diameter of different fittings; and at least one of (A) and (B):

(A) said keg filling plant further comprises a control system configured to receive input commands from a user to control at least the plungers of said cleaning and filling arrangements; and said method further comprises manually selecting, by input of the selection commands into said control system by a user, one of said first plunger and said second plunger to be activated in each of said cleaning and filling arrangements according to the type of fitting of the kegs to be cleaned and filled; and (B) each of the kegs comprises an identification device which corresponds to the type of fitting in the keg;

said keg filling plant comprises at least one recognition module configured to detect the keg identification devices to determine the type of fitting for each keg prior to cleaning and filling of the keg;

said at least one recognition module comprises a computer-assisted image processing system or optically or mechanically functioning sensors; and said method further comprises the step of automatically selecting, by detecting the keg identification device with said at least one recognition module, one of said first plunger and said second plunger to be activated in each of said cleaning and filling arrangements according to the type of fitting of the kegs to be cleaned and filled.

11. The method according to claim 7, wherein:

said first plunger is configured to be moved in conjunction with said second plunger in each of said cleaning and filling arrangements; and said step of engaging and moving said movable valve element of the second keg with said second plunger to open the second keg comprises moving both said second plunger and said first plunger together.

12. The method according to claim 11, wherein at least a portion of said second plunger is disposed within said substantially cylindrical body of said first plunger.

13. The method according to claim 12, wherein:

said centering device comprises at least two centering elements configured to be adjusted to adapt said centering device to the outside diameter of different fittings;

said second plunger is configured and disposed to be plunged into said first plunger upon said second plunger contacting a stationary element of said flat fitting upon axial movement of both of said plungers together;

said first plunger and said second plunger each comprise sealing surfaces configured to be moved relative to each other upon said second plunger contacting a stationary element of said flat fitting upon axial movement of both of said plungers together;

said step of engaging and moving said movable valve element of the first keg with said first plunger to open the first keg comprises:

moving both said first plunger and said second plunger together;

contacting said first end of said filler tube with said elongated body of said second plunger and plunging said second plunger into said first plunger as said first plunger continues moving axially; and engaging and moving said movable valve element of the first keg with said first plunger.

14. A keg filling plant for filling both kegs having flat fittings and kegs having basket fittings with a filling liquid, said keg filling plant comprising:

a cleaning arrangement being configured and disposed to clean empty kegs;

a filling arrangement being configured and disposed to fill cleaned, empty kegs with a filling liquid;

said cleaning arrangement comprising:

a handling apparatus being configured and disposed to handle a keg to be cleaned;

said handling apparatus comprising a centering device being configured and disposed to center a keg in said handling apparatus;

feed and discharge lines being configured and disposed to permit the delivery and removal of cleaning media into and out of a keg;

an actuator element being configured and disposed to move a movable valve element of a fitting of a keg to permit entry and exit of cleaning media into and out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting;

a second plunger comprising an elongated body being configured to be axially moved to engage and move a movable valve element disposed on a tip end of a keg filler tube in a keg to open a keg with a basket fitting; and said filling arrangement comprising:

a handling apparatus being configured and disposed to handle a keg to be filled;

said handling apparatus comprising a centering device being configured and disposed to center a keg in said handling apparatus;

feed lines being configured and disposed to permit filling of a keg with filling liquid;

gas lines being configured and disposed to permit flow of gas out of a keg being filled with filling liquid;

an actuator element being configured and disposed to move a movable valve element of a fitting of a keg to permit entry of filling liquid into a keg and exit of gas out of the keg; and said actuator element comprising:

a first plunger comprising an elongated, substantially cylindrical body being configured to be axially moved to engage and move a ring-shaped movable valve element disposed about an end of a keg filler tube in a keg to open a keg with a flat fitting; and a second plunger comprising an elongated body being configured to be axially moved to engage and move a movable valve element disposed on a tip end of a keg filler tube in a keg to open a keg with a basket fitting.

15. The keg filling plant according to claim 14, wherein:

said first plunger is configured to be moved independently of said second plunger in each of said cleaning and filling arrangements; and said second plunger is configured to be moved independently of said first plunger in each of said cleaning and filling arrangements.

16. The keg filling plant according to claim 15, wherein at least one of (A) and (B):

(A) said keg filling plant further comprises a control system configured to receive input commands from a user to control at least the plungers of said cleaning and filling arrangements to permit manual selection, by input of the selection commands into said control system by a user, of one of said first plunger and said second plunger to be activated in each of said cleaning and filling arrangements according to the type of fitting of kegs to be cleaned and filled; and (B) said keg filling plant comprises at least one recognition module configured to detect keg identification devices in kegs which correspond to the type of fitting in the keg to determine the type of fitting for each keg prior to cleaning and filling of the keg; and said at least one recognition module comprises a computer-assisted image processing system or optically or mechanically functioning sensors.

17. The keg filling plant according to claim 16, wherein:

at least a portion of said second plunger is disposed within said substantially cylindrical body of said first plunger; and said centering device comprises at least two centering elements configured to be adjusted to adapt said centering device to the outside diameter of different fittings.

18. The keg filling plant according to claim 14, wherein:

said first plunger is configured to be moved in conjunction with said second plunger in each of said cleaning and filling arrangements; and at least a portion of said second plunger is disposed within said substantially cylindrical body of said first plunger.

19. The keg filling plant according to claim 18, wherein said second plunger is configured and disposed to be plunged into said first plunger upon said second plunger contacting a stationary element of a flat fitting upon axial movement of both of said plungers together.

20. The keg filling plant according to claim 19, wherein:

said first plunger and said second plunger each comprise sealing surfaces configured to be moved relative to each other upon said second plunger contacting a stationary element of a flat fitting upon axial movement of both of said plungers together; and said centering device comprises at least two centering elements configured to be adjusted to adapt said centering device to the outside diameter of different fittings.

* * * * *